United States Patent [19]

Almer

[11] 4,144,473

[45] Mar. 13, 1979

[54] ELECTRIC INCANDESCENT LAMP WITH CYLINDRICAL FILAMENT

[75] Inventor: Friedrich H. R. Almer, Eindhoven, Netherlands

[73] Assignee: U.S. Philips Corporation, New York, N.Y.

[21] Appl. No.: 799,883

[22] Filed: May 23, 1977

[30] Foreign Application Priority Data

Jun. 28, 1976 [NL] Netherlands ..... 7607038

[51] Int. Cl.[2] ..... H01K 1/14

[52] U.S. Cl. ..... 313/315; 313/217; 313/343; 313/349; 313/356

[58] Field of Search ..... 313/315, 217, 343, 349, 313/356

[56] References Cited

U.S. PATENT DOCUMENTS 3,788,721 1/1974 Vause ..... 313/315 X

*Primary Examiner*—Alfred E. Smith
*Assistant Examiner*—Charles F. Roberts
*Attorney, Agent, or Firm*—Robert S. Smith

[57] ABSTRACT

An incandescent lamp has a hollow cylindrical filament which is constructed from transversal strips each traversing at least for the greater part the circumference of the cylinder at a distance from each other with longitudinal strips connecting the transversal strips together. The strips constitute electrically parallel current paths. Such filaments have improved resistance to deformation a low sensitivity for evolving hot spots, a low weight and compactness.

10 Claims, 10 Drawing Figures

ELECTRIC INCANDESCENT LAMP WITH CYLINDRICAL FILAMENT

The invention relates to an electric incandescent lamp having a light-pervious lamp envelope in which a hollow cylindrical filament is arranged which is connected at its ends to current supply conductors and which comprises a plurality of first electrically-conductive strips of four-sided transverse cross-section and each extending around at least the major part of the circumference of the cylinder, said first strips being spaced apart in the axial direction of the cylinder and being interconnected by a plurality of second strips of a four-sided transverse cross-section and extending mainly in the axial direction of the cylinder.

For clarity, the first strips will hereinafter be referred to as "transversal strips," while the second strips will hereinafter be referred to as "longitudinal strips."

Lamps of the kind mentioned in the peamble are disclosed in British patent specification No. 1,342,070. In these lamps, the filament is formmed by a crenelated cut foil which is curved lengthwise to form a nearly closed hollow cylinder. The crenelated cut foil and the hollow cylinder obtained therefrom are shown in FIGS. 1 and 2 respectively. The transversal strips 2 are connected together by longitudinal strips 1.

The object of the known lamps is to obtain a larger radiating surface and hence and increased luminous efficiency than is possible with lamps having a filament formed from a circular wire.

In the filaments of the known lamps the transversal and longitudinal strips are all arranged in series and there is only one current path through the filament.

Therefore the filaments suffer, as much as wire filaments, from the results of the formation of "hot spots," i.e., places with increased resistance and hence higher temperature, where the evaporation of the filament material occurs more rapidly than elsewhere in the filament. As a result of the faster evaporation the cross-section of the filament decreases more rapidly at the area of the hot spot than elsewhere on the filament. As a result of this the temperature of the hot spot increases further and the evaporation is even further accelerated. Consequently, lamps having filaments in which hot spots can develop reach end of life prematurely in that the filaments fuse at the area of the hot spots.

The filaments further have in common with most of the filaments formed from wire that they have a low resistance to detrition. The danger exists that the filaments sag in the case of horizontal assembly and locally expand and elsewhere contract in the case of vertical assembly as a result of which the transversal strips contact each other. It is also possible that the longitudinal strips which aligned or extend parallel to each other touch each other, as a result of which parts of the filaments are short-circuited. The filament is then overloaded so that it fails prematurely. Therefore it will often be necessary to support the filaments intermediate their ends. However, as a result of the support, parts of the filament are short-circuited and the radiation intensity varies over the length of the filament.

It is the object of the invention to provide electric incandescent lamps having filaments which have a high resistance to detrition and in which hot spots can develop less rapidly and the adverse effect of hot spots on the lifetime is considerably delayed.

According to the invention this object is achieved in lamps of the kind mentioned in the preamble in that at least some of the strips are arranged to form electrically parallel current paths at least over portions of the length of the cylindrical filament and that in filaments having longitudinal portions without electrically parallel current paths the second strips between adjacent longitudinal portions with electrically-parallel-current-paths have such transverse dimensions that in the case of current passage the current density in said strips corresponds to the current densities in the adjacent longitudinal portions with electrically-parallel-current-paths.

The filaments of the lamps according to the invention have a larger resistance to deformation than the known filaments. Whereas in the known filaments the longitudinal strips are situated substantially in line, in filaments of lamps according to the invention they can now be positioned so as to be spread and staggered over the circumference of the cylinder. They are preferably positioned so that the current density in mutually electrically parallel parts of a filament is equal.

"Cylinders" are to be understood to mean herein both cylinders having a circular cross-section and cylinders having differently curved cross-sections, for example an elliptical, and angular, for example rectangular, cross-section.

Since the filaments comprise portions having electrically parallel-arranged current paths, the development of hot spots in these portions is considerably suppressed. If in a parallel current path portion a place should occur in one path having an irregularity, as a result of which the resistance at that area is higher, then this results in a decrease of the current through that path. The place comprising the irregularity assumes a proportionately lower temperature so that the evaporation of the material of the filament is reduced and the life of the filament is extended.

It is generally desired that filaments should have a uniform radiation capacity over their length. For that purpose the current paths should have a comparable current density when current passes through them. In order to achieve this, the strips which connect portions of the filament with parallel current paths have a larger transverse cross-section than strips in which parallel current paths extend. Therefore, such connecting strips, if physical irregularities are present therein, are less subject to the formation of hot spots than if they had the same cross-section as parallel current paths.

For illustration, FIG. 3 shows diagrammatically a simple example of a filament as a developed view in the flat plane. Reference numeral 3 in the figure denotes transversal strips which are connected together by longitudinal strips 4 and 6. 6 denotes longitudinal partions with parallel current paths which paths are each formed by the half of two adjacent transversal strips 3 and a longitudinal strip 4 therebetween. The longitudinal strips 5 which each connect two longitudinal portions with electrically parallel current paths 6 in the drawing have the double width of and the same thickness as the remaining strips and hence have an equal current density when current flows through them. The current flows through the filament in the direction of the arrows P or in the opposite direction.

In a particular embodiment the lamp according to the invention has a filament the composing strips of which form continuous longitudinal parts with electrically parallel current paths throughout the length of the cylindrical filament. The advantage of this embodiment is a further increase of the resistance to deformation of the filament since in this embodiment at least two longitudinal strips are present between every two adjacent transversal strips.

The filaments of the lamps according to the invention may be described as a cylindrical network of conductors. The meshes of the network may have different shapes. In a developed view in the flat plane each mesh is usually elongate in the transversal direction, for example rectangular, or in the form of a parallellogram. The length of such meshes may substantially correspond to the circumference of the cylindrical filament or form only a fraction thereof.

Th filaments may alternatively be considered as a construction built up from elements. In a simple embodiment a number of elements is arranged in series. In any transverse cross-section through the filament there is thus only one element. An example of such a filament, as a developed view in the flat plane, is shown in FIG. 3. In another embodiment the filament consists of two or more strings of in parallel arranged elements, the juxtaposed elements of the various strings being joined together. A filament built up from two strings is shown in FIG. 4 as a developed view in the first plane. For building up a filament mutually equal or congruent elements are frequently used.

FIG. 4 is a diagrammatic developed view in the flat plane of the filament of a lamp according to the invention. This figure shows transversal strips 13 which are connected together by longitudinal strips 10 and longitudinal strips 11 and 12 staggered with respect thereto. Three types of longitudinal portions with parallel current paths can be distinguished in the figure. The filament is constructed therefrom throughout its length. In the portion denoted by 7, strips 10 form electrically parallel current paths, in the portion denoted by 9 the current paths are formed by the strips 11 and 12, while in portion 8 the strip 13 provides four electrically parallel current paths, as shown by the arrows.

Although theoretically the resistance to deformation of the filament would increase if the number of longitudinal strips between every two transversal strips were increased, for practical application an increase above a certain number would produce little effect. Moreover, the electrical resistance of a filament decreases when the number of parallel current paths increases, unless the transverse cross-section through each current path is reduced. An important favorable property of the filaments is their large resistance to deformation in operating conditions. This implies not only their resistance against the influence of gravity, but also their resilience as a result of which they do not deform, even when the material expands as a result of the much higher operating temperature. If the number of longitudinal strips between every two transversal strips were further increased, the resilience would decrease.

Therefore, lamps are generally preferred having filaments in which every two adjacent transversal strips are connected by 2 to 5 longitudinal strips. Filaments having a larger cylinder diameter as a rule have a larger number of longitudinal strips.

It will be obvious that as the number of electrically parallel current paths in any cross-section through th cylindrical filament increases, to the development of hot spots is more strongly suppressed.

The large resistance to deformation of the filaments of the lamps according to the invention means that the material thickness of the filaments can be very low. The material thickness in the radial direction of the filament as a rule is from 5 to 60$\mu$m, preferably from 10 to 30$\mu$m. A result of the small thickness is a high resistance and hence the lamps according to the invention may as a rule have a considerably shorter filament than lamps having filaments of coiled wire or coiled-coil wire. A compact filament is of significance in particular for all those lamps in which it is desired for the filament to be precisely arranged in a given place, for example, in lamps which are used in optical systems, mirror lamps, reflector lamps, and the like.

In order to concentrate the filament as readily as possible in the focus of a mirror or a lens, certain types of lamps are usually constructed as low-voltage lamps. This is the case, for example, in projection lamps. This involves that such lamps require a transformer in the projector so as to be able to operate the projector at mains voltage. However, transformers make projectors not only bulky, but also expensive. Moreover, in low-voltage lamps the current strength at a given power is higher than in mains voltage lamps. Therefore, the contact losses in low-voltage lamps are much higher. An additional drawback thereof is that the lamp base and the fitting obtain a much higher temperature.

The compactness of the filaments now permits the construction of projection lamps, and other lamps in which a concentrated light source is required, as mains voltage lamps.

An important advantage of the lamps is that the weight of the filament as a rule is a fraction of the weight of a coiled coil filament. This means a considerable material saving which may be as much as 80%.

In some types of lamps the filament is formed around a rectangular mandrel. This is done to obtain in one direction a radiating surface which is as large as possible. This is of importance, for example, in projection lamps. However, for the sake of rigidity of the filament, the thickness of the wire from which such a filament is formed is so large that the wire cannot be curved around a very thin mandrel. As a result of this only filaments having a small height/thickness ratio can be obtained, one side in which the height and the length are situated forming the effective radiating surface. As a rule the height/thickness ratio is in the range of 2/1 to 5/1.

The filaments of the lamps according to the invention, however, can be wound around a much thinner mandrel. Height/thickness ratios up to approximately 35/1 can be realized. This means that the efficiency of such lamps with flat filaments has been increased considerably. Besides for projection purposes, these lamps are also very suitable for use when light is required which is polarized for the greater part.

The effective radiating surface of flat filaments can be further increased by arranging the transversal strips in such manner that the location of said strips in one major surface is staggered, preferably over half of the distance between two strips, in the axial direction of the filament with respect to the location of the strips in the other major surface.

In a particular embodiment of the lamp according to the invention the transversal strips surround the circumference of the cylindrical filament entirely and they constitute closed rings. Such lamps have a filament with a great degree of symmetry.

German patent application No. 25 14 494 laid open to public inspection discloses an incandescent lamp the envelope of which comprises light-pervious filters which reflect thermal radiation. If in the known lamp the filament is arranged in the optical center of the filters, a considerable gain is achieved in the number of lumens which is radiated per Watt of consumed power. In a wire-wound filament, however, it is difficult to arrange the filament in such manner as to remain in the optical center of the filters under operating conditions.

An additional advantage of the lamps according to the invention is that they are particularly suitable to be provided with filters due to the great resistance to deformation of the filament, even under operating conditions. Lamps are preferably used having a hollow circular cylindrical filament which is arranged concentrically in a circular cylindrical lamp envelope.

In the operating condition, filaments generally have a lower temperature at the ends and a higher temperature more towards the center. This is caused partly in that the current supply conductors dissipate thermal energy from the ends of the filaments and partly in that the end turns are irradiated by other turns less than are those in the centre. These temperature differences result in differences in intensity of the radiated light along the length of the filament. In halogen lamps the temperature differences may moreover result in an increased transport of the filament material in the axial direction from one portion of the filament to another.

In a particular embodiment of lamps according to the invention, structural measures have been taken to give the filament a substantially uniform temperature throughout its length under operating conditions. These measures may be of a variety of natures. For example, the transversal strips may be situated closer togetehr near the ends of the filament than elsewhere. Although the filaments of the lamps according to the invention are preferably constructed so as to have a uniform current density throughout their length and circumference, strips at the ends of the filament may have a smaller cross-section than corresponding strips elsewhere in the filament. The resulting increased current densities at the ends, may compensate for heat conductivity losses. It is alternatively possible to combine this measure with the one mentioned above.

It is alternatively possible to give, for example, the transversal strip at the end of a filament a smaller cross-section on the side situated nearest to a current supply pole than in places which are situated farther remote from a pole.

Although in incandescent lamps having wire filaments measures can be taken to reduce temperature differences, this is only achievable at the expense of great efforts. The winding of filaments with varying pitch is difficult and expensive and requires complicated machinery. Moreover, differences in pitch do not remain constant during operation. Increasing the wire diameter in the center of the filament at the expense of the diameter near the ends — which can be effected in a fluorine-containing atmosphere — is also expensive and increases the cost-price considerably.

The filaments of the lamps according to the invention on the contrary can be readily obtained, without extra processing during their manufacture, in such a configuration that the temperature profile aimed at is achieved during operation.

Lamps according to the invention of which the filament is not supported intermediate its ends have the additional advantage, when they are constructed as cycle lamps, that the large temperature gradients that normally occur in filament supports are absent. These supports are usually in contact at one end with the comparatively cold wall of the lamp envelope and at the other end with the very hot filament. Consequently, large temperature differences occur in said supports over very small distances. Since filament supports are substantially always manufactured from the same material as the filament, known lamps comprise in the supports large quantities of filament material at a low temperature which can easily be transported by the transport gas over the short distance to the filament so that the geometry of the filament is disturbed.

Due to its favorable properties, tungsten is to be preferred as the constructive material of the filaments of the lamps according to the invention.

The invention also includes lamps which have more than one cylindrical filament. The filaments may be connected or connectable in series or in parallel. Although in some types of lamp the lamp has one filament, this may consist of a number of segments which radiate light when current passes through them and which are connected together electrically by conductors which do not or substantially do not radiate light when current passes through them. Such lamps are used, for example, for copying purposes. The filaments of such lamps usually consist of several parts. Manufacturing such a filament is however expensive and requires complicated constructions.

The invention now permits of providing such lamps with simple filaments. In a favorable embodiment such a lamp has a hollow cylindrical filament having several sections which are constructed from strips and radiate light when current passes through them, said sections being connected together by cylindrical membes which do not or do substantially not radiate light when current passes through them. Such cylindrical connection members preferably have an unperforated surface at least for the greater part.

Starting material in the manufacture of the filaments may be foil material, for example, a foil of a metal for example, tungsten which can withstand high temperatures. The pattern can be provided in the foil in several manners, for example, mechanically by punching, chemically or electrochemically by etching away parts not covered by a resist, or by cutting by means of a laser beam. The foil may then be bent or curved to the desired shape. The edges of the foil which come in the proximity of each other may be secured together, if desired, for example by mechanical means. The filament is annealed, as is usual in filaments, to remove mechanical stresses so that — even when the edges are not secured together — it maintains its desired shape. However, it is alternatively possible to start from a hollow cylindrical body and to provide the pattern in the wall thereof.

The precise shape of the transverse cross-section of the strips of the filament depends on the method of manufacturing the filament. When an etching process is used, the two straight sides of the cross-section which have been situated in the surface of the foil will be connected by two concave sides which are formed by the etching treatment. If the filament has been punched, the cross-section of the strips will be substantially rectangular.

In those cases in which it is desired for the filament to be compact, the length of the longitudinal strips will be chosen to be as small as possible. The distance between two adjacent transversal strips, however, will as a rule be at least equal to half the wall thickness of the cylindrical filament.

The invention and the prior art is shown in the drawing in which

Figure 5:
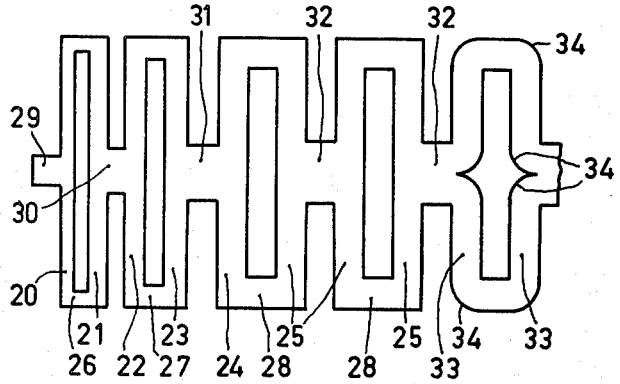
FIG. 5 shows diagrammatically a pattern of tracks provided in a foil before a filament is bent therefrom.

The transversal strips 20 to 25 in the foil shown in FIG. 5 have a width which increases from the left to the right in the figure. Strip 20 is the narrowest, strip 25 is the widest, while the widths of the strips 21 to 24 are between the of strips 20 and 25. The width of the longitudinal strips also increased from strips 26 and 28 and from strips 29 to 31. When current passes through the filament the current density in said filament therefore decreases from the left to the right. As a result of the higher temperature generated by the current at the left-hand end of the filament, heat conduction losses are partly compensated for. A further equalization of the temperature of the filament is achieved in that the length of the longitudinal strips decreases from strips 28 to 26 and from strips 31 to 30, as a result of which the transversal strips 20 and 21 are situated closer together and mutually irradiate each other to a stronger extent than the strips 25.

On the extreme right of FIG. 5 is shown a refinement in which the transversal strips 33 are rounded off locally at their corners 34 so as to make the current density in said strips more uniform.

Figure 6:
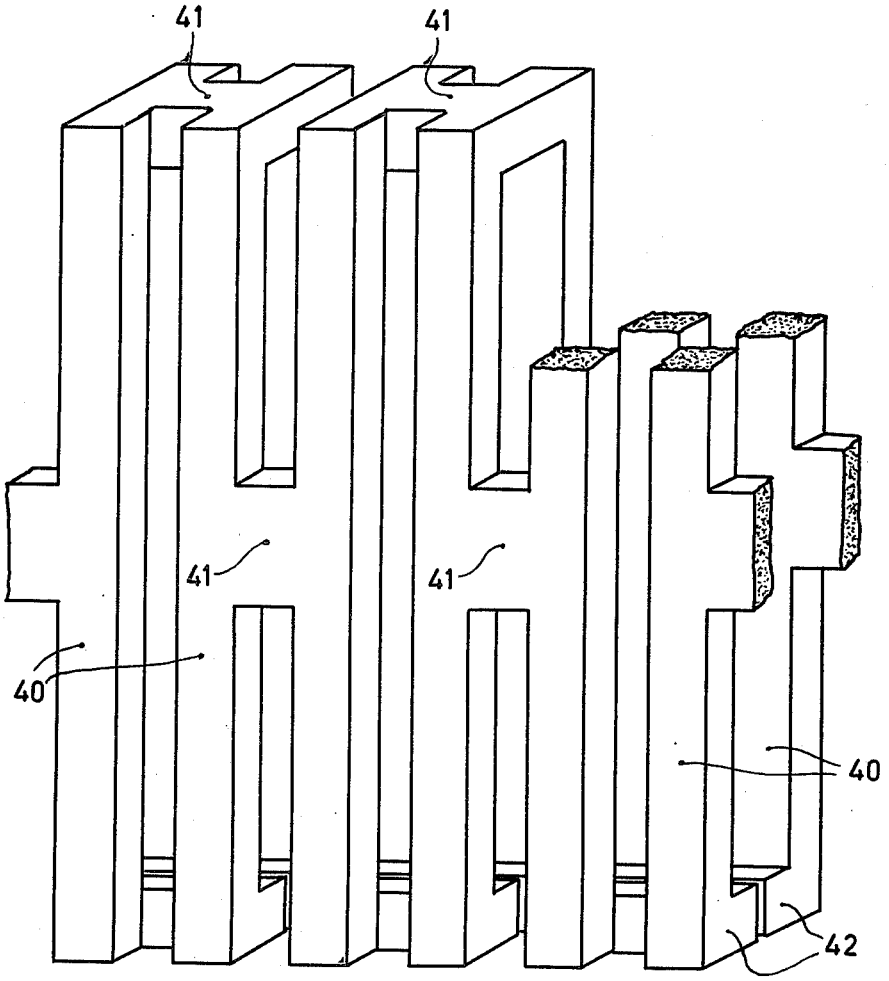
FIG. 6 shows a filament partly broken away.

FIG. 6 shows diagrammatically and partly broken away a flat filament which can be used in a projection lamp. Transversal strips 40 are interconnected by longitudinal strips 41. The ends 42 of the transversal strips are arranged in the proximity of each other and form a slot on the lower side of the filaments.

Figure 7:
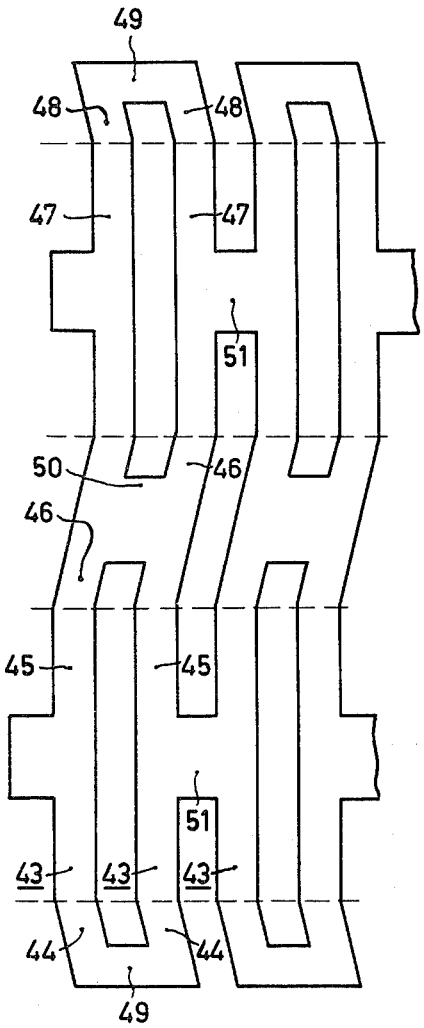
FIG. 7 is a diagrammatic developed view in a flat plane of a filament.

In FIG. 7 each of the transversal strips 43 consists of five parts 44 to 48 which vary in such a manner that the parts 45 and 47 are staggered with respect to each other by half the distance between the centers of two adjacent strips 45. The transversal strips are interconnected by longitudinal strips 49, 50 and 51.

By bending the assembly at right angles about the broken lines, a flat filament is obtained for projection purposes. The parts 45 of the transversal strips which are situated in one major face of the filament are thus shifted over their width in axial direction of the filament with respect to the parts 47 which are situated in the other major face.

Figure 8:
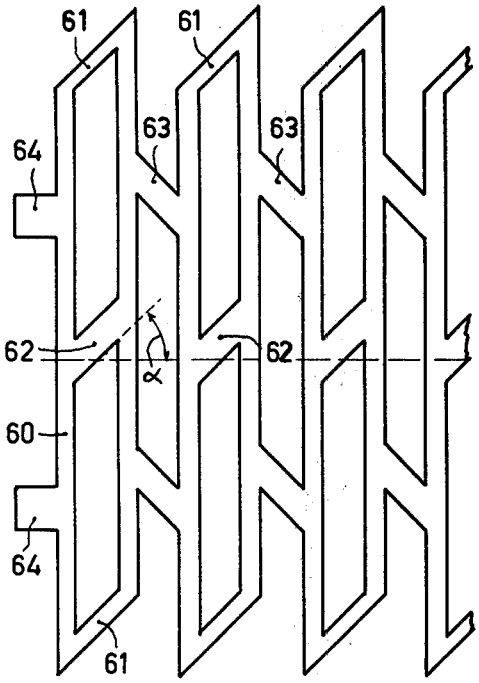
FIG. 8 shows diagrammatically a modified embodiment of the filament shown in FIG. 4.

In the developed view in the flat plane of the filament shown in FIG. 8 the transversal strips 60 are connected together by longitudinal strips 61, 62 and 63 which enclose an angle of at most 45° with the axis of the cylindrical filament. Connection lugs 64 serve for connecting the filament to current supply poles.

Although in the drawing the strips 61 and 62 on the one hand and 63 on the other hand enclose angles with the axis of opposite signs, it is alternatively possible for the strips 63 to extend in the same direction as the strips 61 and 62. When a cylindrical filament is formed from a foil having such a pattern, the slots between opposite strips 61 together constitute a helical line about the filament.

Figure 9:
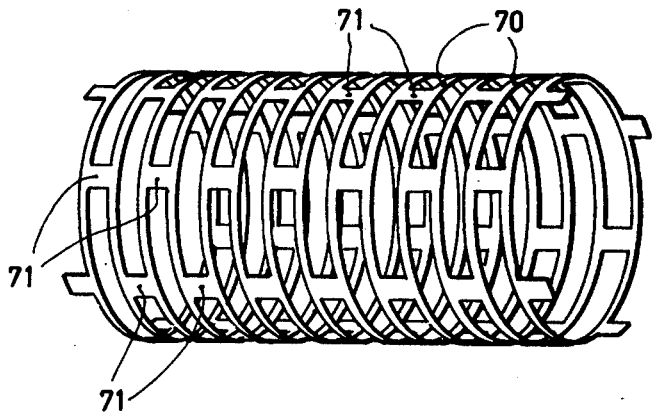
FIG. 9 is an elevation of a filament.

FIG. 9 shows a hollow circular cylindrical filament in which the transversal strips 70 form closed circumferential rings. Four longitudinal strips 71 are situated between every two adjacent strips 70. Therefore, four congruent meshes are present in any cross-section of the filament through strips 71.

Figure 10:
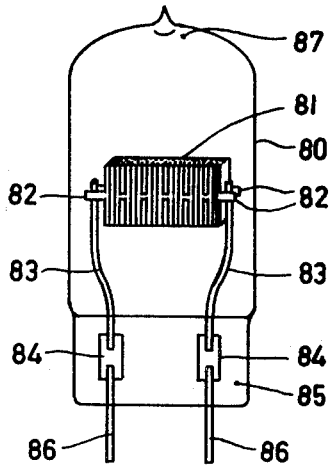
FIG. 10 shows an incandescent lamp.

Reference numeral 80 in FIG. 10 denotes the lamp envelope of a projection lamp. Arranged in said envelope is a flat cylindrical filament 81 the connection lugs 82 of which are connected to internal current conductors 82 which are welded to current lead through conductors 84 situated in the pinch seal 85 and to which are also connected external current conductors 86. The lamp envelope has a tipped-off end 87 and is filled with a halogen-containing inert gas.

EXAMPLES

1. A flat cylindrical tungsten filament was arranged in a lamp envelope (FIG. 10) having an inside diameter of 12 mm. The lamp envelope was filled with 4 atmospheres argon and 10 Torr $CH_2Br_2$, after which the exhaust tube was sealed. The lamp envelope had a capacity of 0.4 $cm^3$.

The filament had a length of 7 mm and a height of 3.5 mm and a thickness of 0.1 mm. The filament (FIG. 6) was formed by bending foil material of 25 μm thickness four times at right angles. As in the filament of FIG. 6, slots were formed in the foil of 3.55 mm length and 25 μ width, so that the width of the transversal strips was 25 μ

The weight of the filament was 12.3 mg. The lamp was operated at 110–120 V and consumed a power of 145 W. No deformation of the filament was observed even after repeated on-off switching operations.

Figure 1:
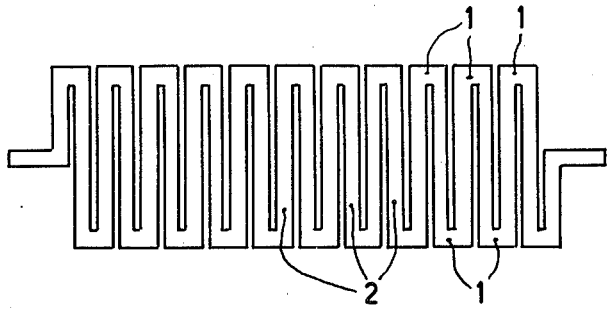
Fig. 1 PRIOR ART
FIG. 1 is an elevational view of a planar prior art member as it is formed from a sheet of foil.
Figure 2:
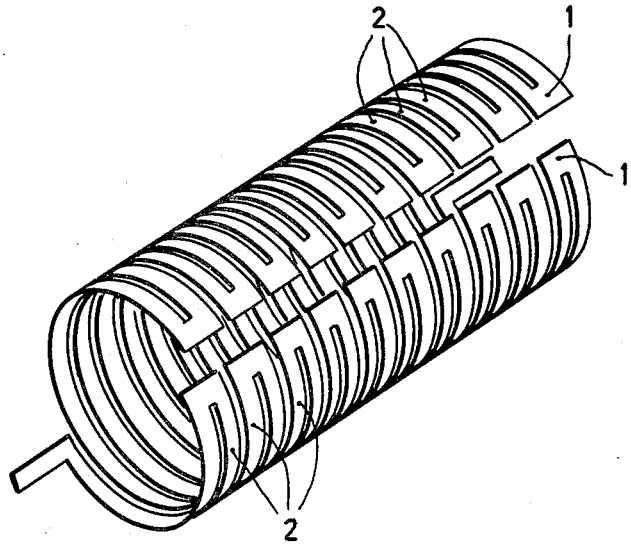
Fig. 2 PRIOR ART
FIG. 2 is a perspective view of the cylindrical filament formed from the planar foil element of FIG. 1.
Figure 3:
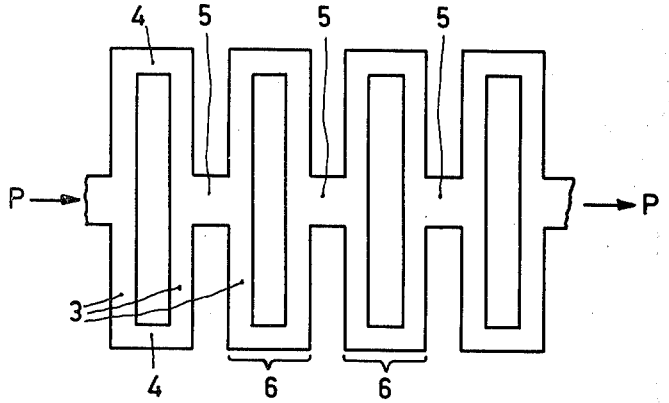
FIG. 3 is a developed view in a flat plane of a portion of the filament in accordance with the invention.

2. An incandescent lamp of comparable dimensions was provided with a tungsten filament having the same external dimensions as in example 1. The filament differed from that of example 1, however, in that the length of the slots which were formed in the filament was 7.15 mm (configuration as shown in FIG. 3). The weight of the filament was 11.2 mg. The lamp was operated at 220 and 230 V and consumed a power of approximately 145 W.

Figure 4:
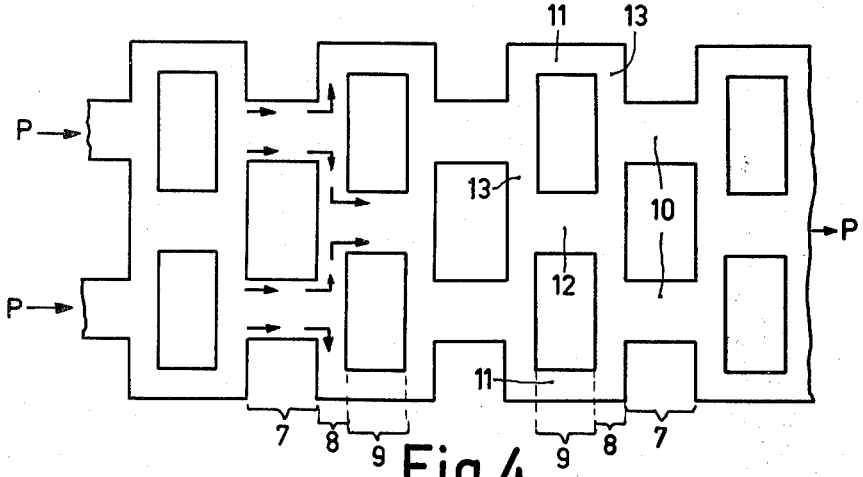
FIG. 4 is also a developed view in a flat plane of the filament in accordance with the invention.

3. The thickness of the tungsten filament material in an incandescent lamp having otherwise the same dimensions and shape as in example 1 was 16 μm. The width of the slots in the filament was 16 μm, their length 3.57 mm. The width of the transversal strips was also 16 μm (configuration of the filament as shown in FIG. 4).

The filament had a weight of 7.24 mg.

The lamp consumed a power of approximately 150 W at 220–230 V.

4. A GLS lamp was provided with a tungsten filament as shown in FIG. 9. The filament had a circular cylindrical shape having a length of 7 mm and an outside diameter of 2.26 mm. The material thickness of the filament was 25 μm. The annular transversal strips and the slots of the filament had a width of 25 μm. The length of the slots was 3.5 mm. The filament had a weight of 18.4 mg (a normal 100 W incandescent lamp has a coil of wire of 44.4 μum diameter and a weight of 30.4 mg.)

The lamp was filled with 600 Torr argon/$N_2$ (92% by volume/8% by volume) and was operated at 110–120 V and consumed a power of approximately 125 W.

The filament had a very large resistance to deformation both during and after operation.

What is claimed is:

1. An electric incandescent lamp having a light pervious lamp envelope in which a hollow cylindrical filament is arranged which is connected at its ends to current conductors, said filament comprising a plurality of first electrically conductive strips having a four-sided transverse cross-section each extending at least the major parts of the circumference of the cylinder, said first strips being spaced apart in the axial direction of the cylinder and being interconnected by a plurality of second strips having a four-sided transverse cross-section and extending mainly in the axial direction of said cylinder, at least some of said strips being arranged to form electrically parallel current paths at least over portions of the length of said filament.

2. The apparatus as described in claim 1 wherein said filament has longitudinal portions without electrically parallel current paths and said second strips between adjacent longitudinal portions with electrically parallel current paths are dimensioned transversely to have substantially the same current density in said second strips as the current densities in the adjacent longitudinal portions with electrically parallel current paths.

3. An electric incandescent lamp as claimed in claim 1 wherein said fist and second strips are so arranged that parallel current paths are provided throughout the entire length of the filament.

4. An electric incandescent lamp as claimed in claim 3 wherein every two of said adjacent first strips are interconnected by between 2 and 5 second strips arranged electrically in parallel.

5. An electric incandescent lamp as claimed in claim 3 in that the cylindrical filament is rectangular in transverse cross-section.

6. An electric incandescent lamp as claimed in claim 5 wherein portions of said first strips disposed in one major side of said rectangular filament are staggered in the axial direction of the filament with respect to the portions of said first strips in the other major side.

7. An electric incandescent lamp as claimed in claim 6 wherein the amount of stagger is equal to half the distance between the centers of two adjacent first strips.

8. An electric lamp as claimed in claim 1 wherein said first strips are closed rings.

9. An electric lamp as claimed in claim 1 wherein said first second strips near the ends of said filament have a smaller cross-section than corresponding strips elsewhere in said filament.

10. An electric incandescent lamp as claimed in claim 9 wherein said first strips are situated closer together near the ends of said filament than elsewhere in said filament.

* * * * *